United States Patent [19]

Kalns

[11] 4,233,504

[45] Nov. 11, 1980

[54] APPARATUS FOR DETECTING THE PASSAGE OF GLOWING EMBERS

[75] Inventor: Rudolph W. Kalns, Pembroke, Mass.

[73] Assignee: Chloride, Incorporated, Tampa, Fla.

[21] Appl. No.: 930,606

[22] Filed: Aug. 3, 1978

[51] Int. Cl.[3] ..... H01J 40/14

[52] U.S. Cl. ..... 250/214 RC; 250/554

[58] Field of Search ..... 250/214 B, 214 RC, , 250/573, 574, 575, 554; 340/630

[56] References Cited

U.S. PATENT DOCUMENTS

| | | | |
|---|---|---|---|
| 3,751,667 | 8/1973 | Quittner | 250/214 B |
| 3,811,046 | 5/1974 | Levick | 250/214 B |
| 3,867,628 | 2/1975 | Brown | 250/214 B |
| 4,032,777 | 6/1977 | McCaleb | 250/214 RC |
| 4,039,844 | 8/1977 | MacDonald | 250/214 RC |

*Primary Examiner*—David C. Nelms

*Attorney, Agent, or Firm*—Robert E. Ross

[57] ABSTRACT

An infrared detector of sufficient sensitivity and stability to provide for the reliable detection of a glowing ember moving through an enclosed carrier system (duct or conveyor) in which a photo-resistive device for viewing the interior of the carrier is connected into suitable circuitry that does not respond to slowly changing ambient light, but which produces a voltage pulse in response to a moving glowing ember passing through the field of view of the detector; said voltage pulse being utilized to provide an output signal which may actuate an alarm or release extinguishant.

3 Claims, 7 Drawing Figures

APPARATUS FOR DETECTING THE PASSAGE OF GLOWING EMBERS

BACKGROUND OF THE INVENTION

In the handling of certain types of combustible materials in particulate or fibrous form, such as cotton or wood particles, it is often convenient to transfer it from one point to another by blowing it through ducts. In such operations it has been found that occasionally a piece of material travelling in the duct will become ignited, possibly due to sparks caused by entrained metallic pieces striking pieces of rotating process machinery.

Although the material may not burst into flame, a smoldering ember will be produced which can eventually result in a serious fire in a mass of stored material at the discharge point of the duct.

Photo-optical detectors have been utilized in an attempt to detect such embers; however, types of which applicant is aware have been found not entirely reliable in detecting such embers, in that they are unstable and often have inadequate sensitivity.

The material being handled often travels at a speed of 50 feet per second, hence an ember travelling near a side wall of the duct may be in the view of the detector for only a few milli-seconds.

Detectors for this purpose of which applicant is aware utilize photoresistive devices as the detector element, and utilize the decrease in resistance of said element to a predetermined value to cause an output alarm signal.

The detection circuitry must be such as to render the device very sensitive to enable it to detect the small radiation output from an ember; however, resistance changes may also occur in such devices as a result of temperature changes and variations in ambient light. Permanent changes also occur as a result of aging. Changes from these effects may reach or exceed the resistance change caused by a passing ember.

Hence the device cannot be operated at its maximum sensitivity because of the possibility of false alarms due to resistance changes caused by the above-mentioned conditions. Detectors of this type, being responsive to ambient light, also require that the carrier enclosures be absolutely light tight.

SUMMARY OF THE INVENTION

A detector is provided for detecting embers travelling in an enclosed carrier in which a photo-resistive device viewing the interior of the enclosure duct is connected into a voltage divider circuit to provide a junction at which a fast rise and fall in voltage occurs as the cell views a passing ember.

Circuitry is connected to said junction which is responsive to voltage variations with predetermined frequency characteristics, to provide an output alarm signal. The alarm signal therefore results from the fast voltage pulse occurring at the voltage divider junction, and the response of the system is virtually independent of the actual resistance of the photo-resistive device.

DESCRIPTION OF THE ILLUSTRATED EMBODIMENT

Figure 1:
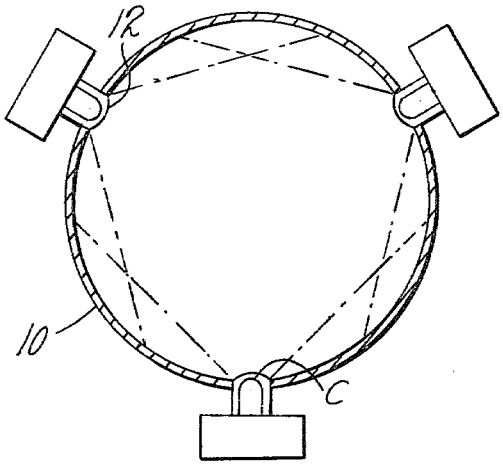
FIG. 1 is a schematic view of three detectors of the invention assembled with a duct so as to view the interior thereof.
Figure 2:
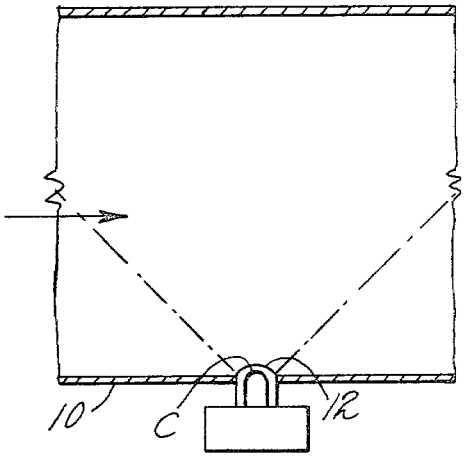
FIG. 2 is a view in section taken on line 2—2 of FIG. 1.

Referring to the drawings, there is illustrated a detector particularly adapted for use in detecting glowing embers in material travelling in a duct, such as fibrous or particulate combustible material.

The detector comprises a photo-resistive cell C which may be suitably mounted in an aperture in the side wall of a duct 10, and provided with a lens 12, to enable the cell C to view the interior of the duct. In the usual installation 3 or more detectors may be equally spaced around the duct, since the opacity of the material being blown through the duct could prevent the detector from seeing an ember travelling on the opposite side of the duct.

Figure 3:
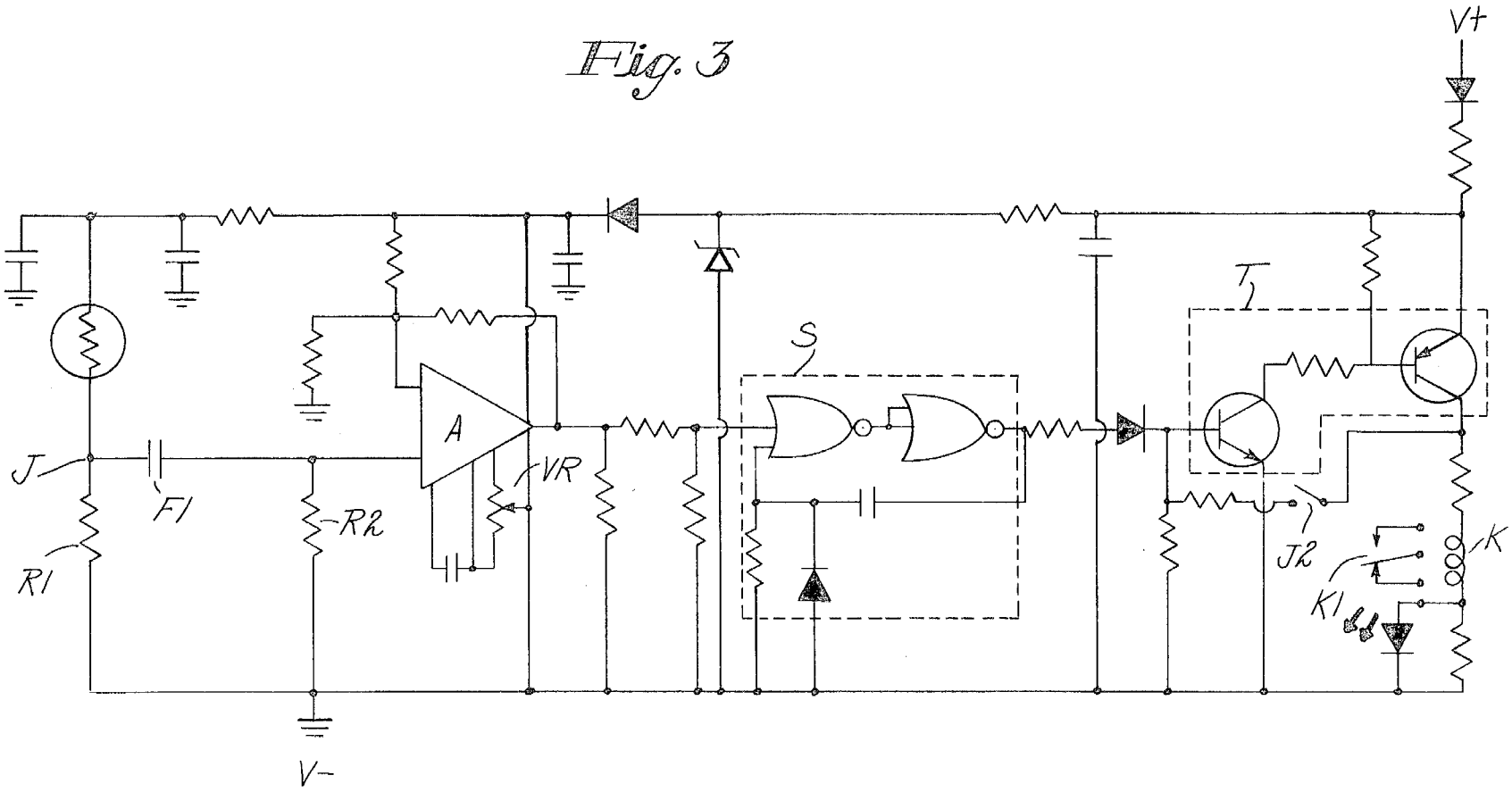
FIG. 3 is a schematic diagram of an electronic circuit embodying the features of the invention.

The detector cell C is connected into suitable circuitry (FIG. 3) to provide an alarm output signal when a glowing ember passes through the viewing area of the cell. For this purpose the cell C is connected in series with a resistor R1 across a voltage source V to form a voltage divider so that the voltage at the junction J varies inversely with the resistance of the cell C.

The junction J is connected through a differentiator comprising capacitor F1 and resistor R2 to the input of a high gain amplifier A. The output of the amplifier A is connected to the input of a one-shot multi-vibrator S, the output of which is connected to suitable transistor driver circuitry T for energizing the coil of a relay K which may transfer contacts K1 for any desired purpose.

Figure 4:
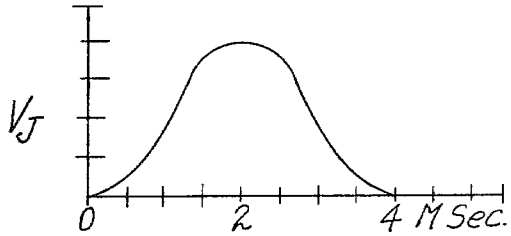
FIG. 4 is a graph of a voltage wave form generated at the cell voltage divider junction of FIG. 2.

Referring to FIG. 4, there is illustrated a graph of the voltage pulse produced at the junction J when an ember passes through the field of view of the detector at a speed and distance such that it is in the field of view of the detector for only 4 milliseconds. As the ember passes through the field of view, the resistance of the cell C drops at a rate in response to radiation from the ember which is a function of the speed of the ember, resulting in a corresponding rate of rise in voltage at the junction J. As the ember passes the radiation decreases and the voltage at junction J falls to its original value.

Figure 5:
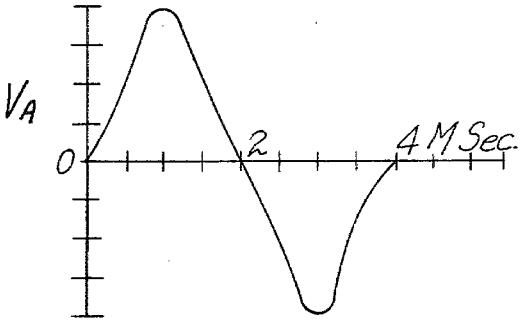
FIG. 5 is a graph of the voltage wave form generated at the input of the amplifier.

Capacitor F1 and resistor R2 act as a differentiator so that the voltage pulse at J causes a positive and negative pulse to appear at the input to amplifier A (see FIG. 5). Amplifier A may be an operational amplifier with a gain of 2400. The output of the amplifier produced in response to the positive portion of the input pulse of FIG. 5 is shown in FIG. 6.

Figure 6:
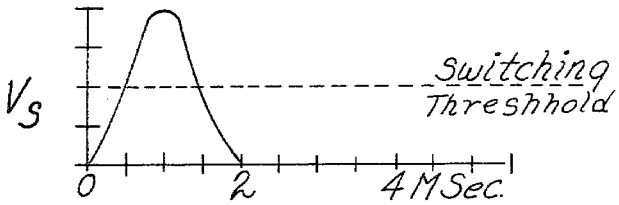
FIG. 6 is a graph of the voltage wave form at the output of the amplifier.
Figure 7:
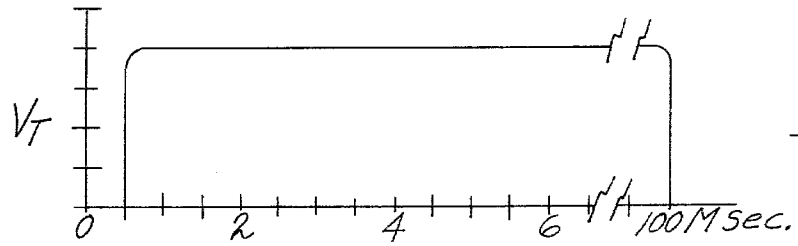
FIG. 7 is a graph of the output of the one-shot multivibrator on an arbitrary voltage scale, showing the timing of its operation in relation to the voltage pulses in the other portions of the circuit.

If an input pulse to the amplifier is of sufficient magnitude to produce an output pulse meeting the signal level voltage requirements of the monostable multi-vibrator as illustrated in FIG. 6, the multi-vibrator produces an output pulse (FIG. 7) of more than sufficient time duration, such as 100 milliseconds, to actuate the relay or other alarm device. An optional relay latching circuit may be provided by a removable jumper J2 from the relay coil input to the input of the transistor driver circuit S.

Due to the A.C. coupling between the cell C and the amplifier A, the system does not depend on a specific resistance value of the cell C to actuate the alarm, but is responsive only to fast changes in resistance. The system is therefore immune to changes in cell resistance caused by low level ambient light, by aging, or by temperature changes.

In a preferred embodiment of the invention, I utilize a photo-resistive cell made of lead sulfide or lead selenide. Such cells have a fast response, and have a peak sensitivity in the infra-red band.

A suitable optical filter can also be used in front of the cell to eliminate the possibility of actuation of the circuit by radiation sources having a substantial output in the visible through near infrared portion of spectrum with little or no infrared (blackbody) content, such as fluorescent lamps.

It will be apparent to one skilled in the art that with minor changes in circuitry, a system utilizing the principles of the invention could be built using a photo-voltaic cell in place of the photo-resistive cell. However, photo-voltaic cells of which applicant is aware, do not have the infrared response above 1 micron or the sensitivity required for the detection of such embers; however, such a circuit would be useful in other applications where high infrared response is not required. It is also possible that improvement in photo-voltaic devices may be made that will increase their response to a value such that they will be satisfactory for use in the above-described application. Therefore I do not wish to limit the invention to the use of only photo-resistive devices.

Although the above-described embodiment of the invention is intended for use in detecting embers in material moving in a carrier enclosure, the principles of the invention can be utilized for other applications, where it is desired that an output response be obtained to extremely short optical phenomena, such as flame ignition, explosive combustion, etc.

Since certain other changes apparent to one skilled in the art may be made without departing from the scope of the invention, it is intended that all matter contained herein be interpreted in an illustrative and not a limiting sense.

I claim:

1. A duct system comprising an opaque wall portion and a detector for detecting a single glowing ember travelling through said opaque wall portion, said detector comprising a photo-resistive cell connected in series with a resistor across a voltage supply, the voltage at the junction between the cell and resistor varying as a function of the resistance of the cell, said junction being coupled to the input of an AC responsive device through a differentiator, whereby an ember moving through the field of view of the photo-resistive device causes a drop in resistance of the cell to cause a voltage change at the junction, the input and output of said AC responsive device being proportional to the rate of change of said voltage change at the junction, and means responsive to an output of said AC responsive device above a predetermined magnitude to actuate an alarm.

2. A duct system for conveying flammable particulate material of the type which is susceptible to containing glowing embers of said particulate material, said system including a portion with an opaque wall, a plurality of optical detectors disposed at circumferentially spaced positions around said opaque wall and viewing the interior thereof, each of said detectors comprising a photo-resistive cell connected in series with a resistor through a junction across a voltage supply, whereby a change of resistance of said photo-cell occurs when the photo-cell views a glowing ember travelling in the duct causing a corresponding change in voltage at said junction, differentiator means connected to said junction which produces an output voltage which is a function of the rate of change of said junction voltage and means responsive to a rate of change of predetermined amplitude to actuate an alarm.

3. A detector system for detecting and providing an output response in response to a single suddenly-occurring optical phenomenon of short duration, comprising a photo-responsive cell connected with suitable circuitry to provide a first voltage pulse in response to the viewing of said phenomenon by said cell said first pulse having a rise time which is a function of the speed of occurrence of said phenomena, means responsive to said first pulse to provide a second pulse having a maximum value which is a function of the rate of change of the voltage of said first pulse, amplifier means receiving said second pulse and an electronic switching means receiving the amplifier output, said electronic switching means being responsive only to an amplifier output above a predetermined value to shift from a first condition to a second condition, said predetermined value of the amplifier output being produced only by a first pulse having a rate of voltage increase above a predetermined rate.

* * * * *